United States Patent [19]

Guarnaccia et al.

[11] Patent Number: 4,860,452

[45] Date of Patent: Aug. 29, 1989

[54] SINGLE EDGE RAZOR BLADE WITH INTEGRAL BACK

[75] Inventors: Joseph J. Guarnaccia, Wethersfield; Ernest J. Masucci, Plantsville, both of Conn.

[73] Assignee: The Stanley Works, New Britain, Conn.

[21] Appl. No.: 282,490

[22] Filed: Dec. 12, 1988

[51] Int. Cl.[4] ..... B26B 21/54

[52] U.S. Cl. ..... 30/346.6; 30/346.5

[58] Field of Search ..... 30/346.5, 346.58, 346.59, 30/346.6, 348, 346

[56] References Cited

U.S. PATENT DOCUMENTS

| | | | |
|---|---|---|---|
| 1,135,008 | 4/1915 | Fuller | 30/346.6 |
| 2,019,122 | 10/1935 | Duritza | 30/346.6 X |
| 2,108,267 | 2/1938 | O'Neill | 30/346.6 X |

FOREIGN PATENT DOCUMENTS

| | | | |
|---|---|---|---|
| 297251 | 9/1928 | United Kingdom | 30/346.6 |

*Primary Examiner*—Douglas D. Watts

*Attorney, Agent, or Firm*—Chilton, Alix & Van Kirk

[57] ABSTRACT

This invention relates to razor blades and more particularly to a single edged blade for shaving or scraping. The blades are reinforced in various ways to make them stiff enough for scraping.

11 Claims, 3 Drawing Sheets

SINGLE EDGE RAZOR BLADE WITH INTEGRAL BACK

BACKGROUND AND SUMMARY OF THE INVENTION

This invention relates to razor blades and, more particularly, to a single edge razor blade of the type which can be employed for personal shaving and in hand tools for scraping and cutting.

Single edge blades of the type utilized in hand tools for scraping or cutting have a backing along the top edge to take the scraping or cutting forces applied to the blade during use and to prevent abrading of the hand tool. The backing also provides a thickness to facilitate mounting of the relatively thin blade to the blade holder of the hand tool and rigidifies the thin blade lengthwise for a straight cutting or scraping edge.

Generally, the backing is aluminum and it is secured to the top edge of the steel blade by staking. Such a backing is susceptible to loosening due to use or due to improper staking and may slip during usage causing injury to the user or unsatisfactory performance.

Accordingly, it is an object of the present invention to provide a new and improved one-piece single edge razor blade with an integral backing to eliminate slippage between the backing and the blade body.

Another object of the invention is to provide such a one-piece blade wherein the integral backing is securely interlocked to the blade body for a sturdy blade configuration.

A further object of the invention is to provide a single edge razor blade which affords a new and improved mounting capability for attachment to a complementary hand tool.

Yet another object of the invention is to provide a one-piece single edge blade which is durable in use and economical to manufacture.

Other objects will be in part obvious and in part pointed out more in detail hereinafter.

It has been found that the foregoing related objects and advantages are attained in an integral one-piece single edge razor blade having an elongated flat sheet metal main blade body with a cutting edge along the bottom longitudinal edge and an integrally formed force bearing blade backing extending along the top thereof. The blade backing integrally extends from the top of the main blade body and is of general U-shaped cross section with opposing forward and rearward walls disposed generally parallel to the main blade body and offset therefrom on opposite sides thereof. One of the forward and rearward walls is integrally connected to the top of the main blade body and the other of the forward and rearward walls has an interlock portion for interlocking the other of the forward and rearward walls to the blade body.

DESCRIPTION OF THE PREFERRED EMBODIMENT

Figure 1:
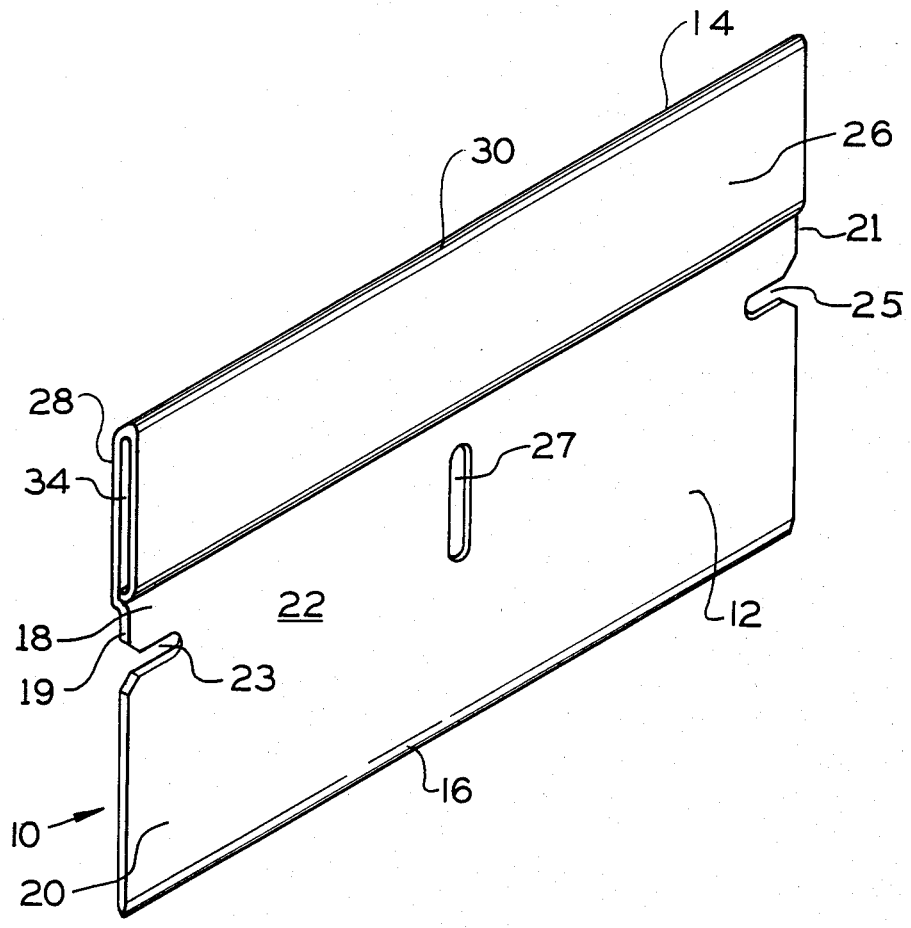
FIG. 1 is a perspective view of the single edge razor blade of the present invention.

Although specific forms of the invention have been selected for illustration in the drawings and the following description is given in specific terms for the purpose of describing these forms of the invention, this description is not intended to limit the scope of the invention which is defined in the appended claims.

Referring to the drawings wherein the same numerals are utilized to identify the same or like parts in the several embodiments, the single edge razor blade of the present invention is designated by the numeral 10 and generally comprises a planar blade body 12 with an integral backing 14 extending longitudinally along the top of the blade body 12 and a cutting edge 16 extending longitudinally along the bottom edge of the blade body.

For purposes of explanation, the blade body 12 is identified herein as having a top portion 18, a bottom portion 20, opposed sides 19, 21 and forward and rearward planar faces 22, 24. The longitudinally extending notches 23, 25 in the sides 19, 21 respectively and the vertically extending slot 27 in the top portion 18, a bottom portion 20, opposed sides 19, 21 and forward and rearward planar faces 22, 24. The longitudinally extending notches 23, 25 in the sides 19, 21 respectively and the vertically extending slot 27 in the top portion 18 facilitate mounting the blade 10 to a hand tool in a conventional manner. Other acceptable configurations of notches 23, 25 and slot 27 may be utilized although the preferred configurations are shown in FIG. 1.

The backing 14 is integrally formed along the top of the blade body 12 and has opposed spaced apart forward and rearward walls 26, 28 generally parallel to the blade body 12 and offset therefrom on opposite sides of the blade body. That is, the forward wall 26 is disposed forwardly of the forward face 22 of the blade body and the rearward wall 28 is disposed rearwardly of the rearward face 24 of the blade body.

Figure 2:
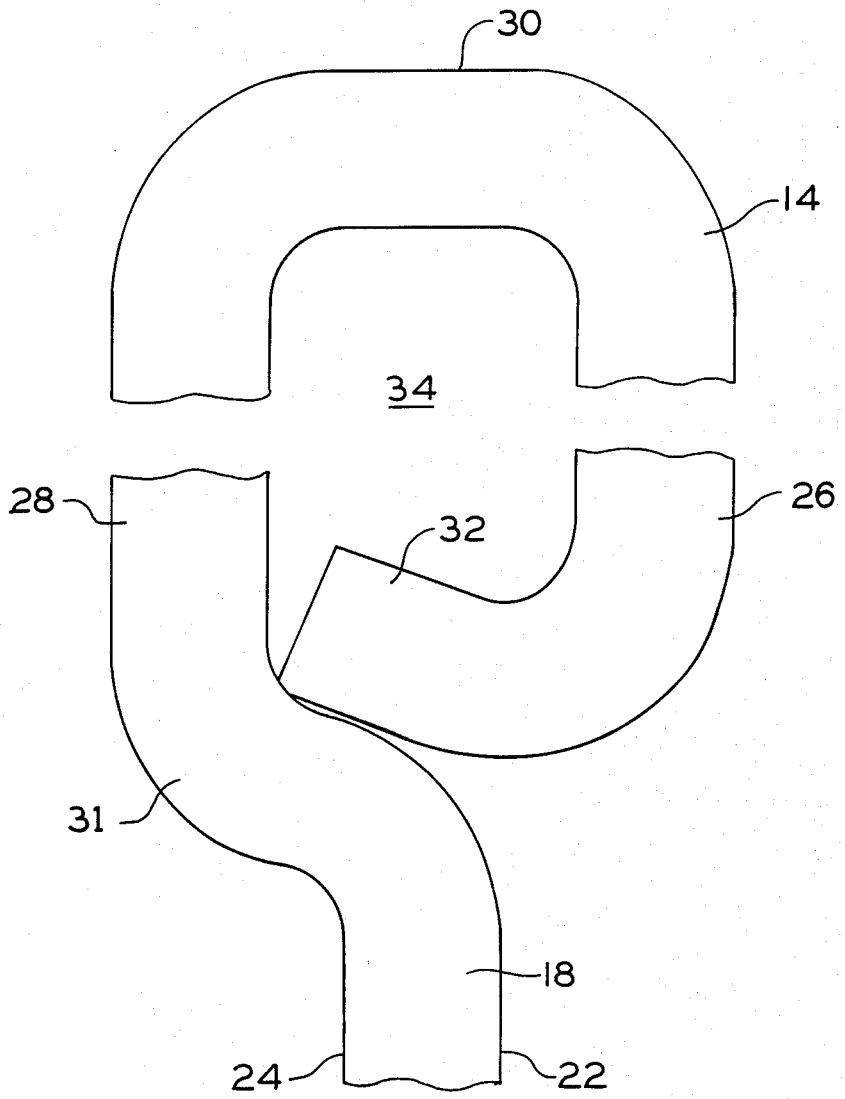
FIG. 2 is an enlarged partially broken away side view of the integral backing of the blade of FIG. 1.

The upper edge 30 of the backing 14 is rounded and integrally connects the forward and rearward walls 26, 28 to form a generally U-shaped cross-sectional configuration. A connector portion 31 integrally connects the lower portion of the rearward backing wall 28 to the top portion 18 of the blade body 12. As can be seen in FIG. 2, the connector portion 31 has a double bend whereby it generally extends obliquely from the top portion 18 to the rearward backing wall 28.

The terminal end of the forward backing wall 26 is inwardly bent to provide an integrally formed retaining or locking lip 32 extending along the entire length of the forward backing wall for interlocking the terminal end against the connector portion 31. As best seen in FIG. 2, the forward and rearward walls 26, 28 define a space or slot 34 therebetween and the retaining lip 32 extends rearwardly and inwardly into the space 34 into retentive engagement with the connector portion 31 so as to mechanically interlook the terminal end of the forward wall 26 to the blade 10. Such interlocking provides a strong secure integral backing to take the forces applied by a hand tool during heavy duty cutting and scraping without separating or deforming and which also permits utilization of a new and improved mounting capability as noted hereinafter. As can be appreciated, the mechanical interlocking of the terminal end of the integral backing 14 contributes to economy of manufacture. Additionally, the locking lip 32 maintains the backing walls 26, 28 in predetermined spaced disposition. In the illustrated embodiment, the thickness of the blade material is 0.010 inches and the distance between the backing walls 26, 28 is approximately 0.020 inches to provide an overall backing thickness of 0.040 inches. Other acceptable blade thicknesses may also be utilized.

Alternately, the retaining lip 32 may also be rolled or curved upwardly so as to engage the interior surface of rearward backing wall 28. Other acceptable means for interlocking the terminal end of the forward wall 26 may also be utilized.

Referring to FIG. 1, the space 34 defined by the forward and rearward walls 26, 28 is in the form of an elongated slot which extends longitudinally through the backing 14 along the entire length of the blade 10. The slot 34 is open ended at the opposite longitudinal ends of the backing 14 and provides a longitudinal mounting slot adapted for receiving the cooperating mounting member of a hand tool (not shown) for aligning and securely connecting the blade 10 to the hand tool. Accordingly, the conventional configuration of notches 23, 25 and slot 27 may be eliminated.

Figure 3:
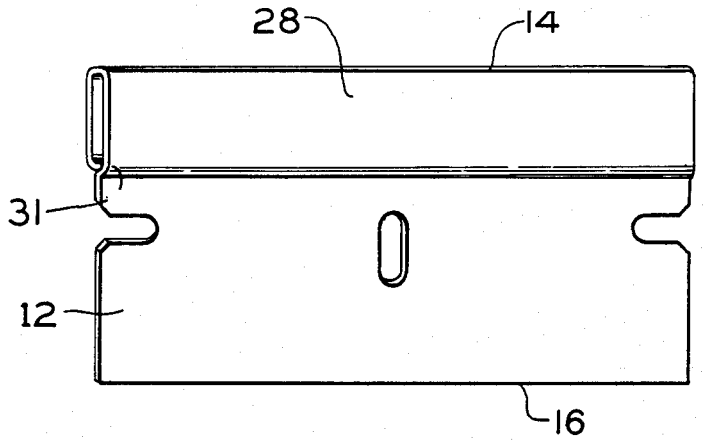
FIG. 3 is a diagrammatical view of another embodiment of the single edge razor blade of the present invention.

In the embodiment of FIG. 1, the one-piece single edge razor blade 10 is integrally formed from sheet steel. The sheet steel is appropriately formed by bending, stamping and the like into a strip of blade blanks which is heat treated through known processes to a desired hardness (e.g., a hardness of R15N 90 to R15N 91.5), ground to provide a cutting edge, and broken into individual blades. The ultimate blade is preferably hardened steel and fully martensitic. Alternately, the blade 10 may be heat treated to have a differential composition with varying hardening characteristics. Referring to FIG. 3, an alternate embodiment of the blade 10 is shown having a differential composition as diagrammatically indicated relative to the dimensions of a conventional single edge blade wherein the hardness of the top portion is less than the hardness of the bottom portion. In the blade 10 of FIG. 3, the blade body 12 is fully martensitic from the cutting edge 16 to approximately 0.125 inches from the backing 14 where the composition of the blade changes with pearlite being found in the core structure. At approximately 0.040 inches from the backing 14, the blade structure changes to a mixture of approximately 50 per cent martensite and 50 per cent pearlite for the remainder of the blade. Consequently, the upper portion of the blade body 12 and the backing 14 have a relatively soft yet tough outer skin and enhanced flexibility as a result of the differential composition for prolonged blade life.

Accordingly, a one-piece single edge razor blade with an integral backing is provided which eliminates slippage between the backing and the blade body. Additionally, this single edge razor blade affords a new and unique mounting capability for mounting to a complementary hand tool. As will be apparent to persons skilled in the art, various modifications and adaptations of the structure above described will become readily apparent without departure from the spirit and scope of the invention, the scope of which is defined in the appended claims.

We claim:

1. An integral one-piece single edge razor blade adapted for mounting in a hand tool of the type employed for shaving, scraping or cutting comprising:

an elongated planar body having forward and rearward faces, an upper end and a lower end, said lower end forming a longitudinally extending cutting edge, a force-bearing backing portion integrally formed at said upper end of said planar body and extending longitudinally along said planar body for receiving scraping and cutting forces applied to said blade by an interconnected hand tool, said backing portion having opposed forward and rearward walls generally parallel to said planar body to provide a generally uniform transverse backing thickness along the planar body, said forward wall being disposed forwardly of said forward face of said planar body and said rearward wall being disposed rearwardly of said rearward face of said planar body, said backing portion having a first end integrally interconnected to said upper end of said planar body and a second terminal end portion, and means integrally formed with said terminal end portion of said backing portion for interlocking said terminal end at the upper end of said planar body.

2. The device of claim 1 wherein said terminal end portion of said backing portion is adjoining said forward wall of said backing portion and said terminal end has an integral retaining lip extending generally rearwardly intermediate said forward and rearward walls in interlocking engagement with said upper end of said planar body.

3. The device of claim 2 wherein said forward and rearward walls of said backing portion define a space therebetween and said retaining lip extends into said space into interlocking engagement with said rearward wall.

4. The device of claim 3 wherein said retaining lip is curved upwardly within said space.

5. The device of claim 1 wherein said forward and rearward walls of said backing portion define a longitudinally extending open-ended mounting slot therebetween adapted to receive a cooperating mounting member of a hand tool for mounting said blade to the hand tool.

6. The device of claim 1 wherein said blade is hardened steel with said upper end of said planar body having a predetermined hardness which is less than the hardness of said lower end.

7. The device of claim 6 wherein said lower end of said planar body is generally fully martensitic and said upper end of said planar body includes a predetermined amount of pearlite.

8. A one-piece single edge razor blade well suited for mounting in a manual instrument of the type employed for shaving, scraping or cutting comprising:

an elongated flat sheet metal main blade body having a sharp cutting edge along the bottom longitudinal edge thereof and an integrally formed force-bearing blade backing extending along the top thereof, said blade backing integrally extending from the top of said main blade body and being of generally U-shaped cross section with opposing forward and rearward walls disposed generally parallel to said main blade body and offset therefrom on opposite sides thereof, the walls of said backing being spaced by a distance up to approximately twice the thickness of said main blade body, one of said forward and rearward walls being integrally connected to the top of said main blade body by a connector portion extending obliquely to said blade body, the other of said forward and rearward walls having an interlock portion cooperating with said connector portion for fixably maintaining the spaced relationship of said walls at the top of said blade body.

9. The device of claim 8 wherein said interlock portion comprises a retaining lip portion integrally formed on the other of said forward and rearward walls and being in interlocking engagement with said connector portion.

10. The device of claim 9 wherein said forward and rearward walls define a space therebetween and said retaining lip extends into said space into engagement with said one of said forward and rearward walls.

11. The device of claim 8 wherein said forward and rearward walls of said back portion define a longitudinally extending open-ended slot therebetween for receiving a cooperating mounting member of a hand tool for mounting said blade to the hand tool.

* * * * *